United States Patent [19]

Thomas et al.

[11] 4,248,953

[45] Feb. 3, 1981

[54] PROCESS FOR THE PRODUCTION OF PHOTOCONDUCTIVE ZINC OXIDE OF IMPROVED ELECTROPHOTOGRAPHIC PROPERTIES, AND PRODUCT THEREOF

[75] Inventors: Charles L. Thomas; Sam C. Carapella, both of South Plainfield, N.J.

[73] Assignee: ASARCO Incorporated, New York, N.Y.

[21] Appl. No.: 35,653

[22] Filed: May 3, 1979

Related U.S. Application Data

[63] Continuation-in-part of Ser. No. 879,300, Feb. 21, 1978, abandoned.

[51] Int. Cl.[3] ..... G03G 5/08

[52] U.S. Cl. ..... 430/88; 430/127

[58] Field of Search ..... 430/87, 88, 90, 95, 430/127

[56] References Cited

U.S. PATENT DOCUMENTS

| | | | |
|---|---|---|---|
| 3,801,316 | 4/1974 | Bowman | 430/88 |
| 4,098,609 | 7/1978 | Logue et al. | 430/90 |

*Primary Examiner*—Edward C. Kimlin
*Assistant Examiner*—John L. Goodrow
*Attorney, Agent, or Firm*—Kenneth A. Koch

[57] ABSTRACT

Photoconductive zinc oxide characterized by having improved electrophotographic properties and particularly increased discharge speed, and produced by a process involving mixing the photoconductive zinc oxide powder to be improved with 0.01% by weight or more tellurium calculated as Te, and contacting the thus-obtained mixture with a free oxygen-containing gas while heating the mixture at elevated temperature sufficiently high and for a time sufficient to result in the zinc oxide having the improved electrophotographic properties. The heating temperature and/or heating time is held below that temperature or time at which sintering of the thus-treated product occurs.

10 Claims, No Drawings

PROCESS FOR THE PRODUCTION OF PHOTOCONDUCTIVE ZINC OXIDE OF IMPROVED ELECTROPHOTOGRAPHIC PROPERTIES, AND PRODUCT THEREOF

BACKGROUND OF THE INVENTION

1. Related Applications

This application is a continuation-in-part of U.S. Ser. No. 879,300 filed Feb. 21, 1978 now abandoned.

2. Field of the Invention

This invention relates to photoconductive zinc oxide and more particularly to a process for the production of photoconductive zinc oxide of improved electrophotographic properties, particularly at least a 10% increase in discharge speed relative to the same photoconductive zinc oxide that has not been processed in accordance with the invention, and to the product photoconductive zinc oxide of improved electrophotographic properties per se.

3. Description of the Prior Art

U.S. Pat. No. 3,801,316 discloses converting photoconductive zinc oxide into bicharge photoconductive zinc oxide by heating with selenium in air at a temperature of about 300° C.–600° C.

U.S. Pat. No. 3,897,248 discloses a process for improving the electrophotographic properties of photoconductive zinc oxide by blending the zinc oxide with a sulphurizing agent, e.g. flowers of sulphur or a sulphur-bearing compound, and tempering the blend in an oxidizing atmosphere at a temperature in the approximate range 500° to 950° C. for a time within the range 10 seconds to 3 hours. The product of the tempering is rapidly cooled to room temperature.

U.S. Pat. No. 3,816,116 discloses a photosensitive layer for electrophotography composed of Se-Te alloy containing more than 0.01% and less than 3 percent by weight of tellurium. The Se-Te alloy has a N-type polarity and is produced by vapor depositing selenium and tellurium on a substrate maintained at a temperature of 60°–70° C.

The U.S. Pat. No. 4,043,813 teaches an improved photoconductive surface coating having panchromatic sensitivity and increased resistance against spectral response shift upon reuse. The disclosed coating is composed of zinc oxide particles, a binder and a minor amount, defined as at least 0.5%, of a selenide or telluride compound which is substituted for a sensitizing dye that is normally present in formulations of the disclosed type.

In the formulation of a satisfactory electrophotographic paper coating material, there are certain performance characteristics to be considered. Such a coating must be capable of accepting a high electrostatic charge and of retaining the charge over reasonably long intervals, must be capable of discharging, i.e. losing the charge very rapidly on exposure to light, and must leave little or no charge on the areas which have been exposed. Thus, the electrophotographic properties of such a coating material which determine its suitability for use in photocopying depend upon the charge acceptance, dark decay, light decay and residual charge characteristics of the material. Further, not only are the characteristics of the ZnO important in the coating formulation, but also how the ZnO is affected in combination with the other constituents and ratios of constituents of the formulation which include (1) the resin or binder, (2) the dye, (3) the sensitizer, (4) extenders and the thinner. In addition, the paper coat weight as normally expressed in lbs. of ZnO/ream has a significant effect on photoconductive paper quality.

BRIEF SUMMARY OF THE INVENTION

The invention provides photoconductive zinc oxide characterized by having considerably improved electrophotographic properties, especially a consistently higher discharge speed that is at least 10% higher than the discharge speed of the same photoconductive zinc oxide not having the tellurium mixed therewith and treated according to the invention.

The photoconductive zinc oxide having the improved electrophotographic properties of this invention is prepared by a process of this invention comprising mixing the photoconductive zinc oxide powder to be improved with from about 0.01% to about 0.05% by weight of tellurium, calculated as Te, such percent of tellurium being based on the weight of the zinc oxide. For optimum results, the amount of Te should not exceed 0.03% by weight and is most preferably about 0.02% by weight. All percentages herein referred to are percentages by weight.

The thus-obtained mixture is then contacted with a free oxygen-containing gas while heating the mixture at an elevated temperature sufficiently high and for a time sufficient to result in the thus-treated zinc oxide having the improved electrophotographic properties. The heating temperature and/or heating time are below that temperature or time at which significant sintering of the thus-treated product occurs.

The considerable improvement in electrophotographic properties provided by the addition to the photoconductive zinc oxide of tellurium in the 0.01% to 0.05% range, relative to the same untreated photoconductive zinc oxide, was entirely unexpected. More specifically, it was unexpectedly discovered, that the addition of from 0.01% to about 0.03% by weight of Te to various grades of photoconductive zinc oxide and processing the mixture in accordance with the method of the invention, consistently resulted in an increase of at least 10% in the discharge speed, relative to the untreated and same grade of photoconductive zinc oxide. In many instances, the discharge speed would increase substantially more than 10%, i.e. 20–30%. It was also discovered that increasing the amount of Te above about 0.03% by weight, i.e. to 0.05% by weight did not result in any significant improvement in discharge speed relative to its value at a Te content of 0.02%.

The zinc oxide containing the added tellurium in accordance with this invention also exhibits the other aforementioned performance characteristics and is compatible with the other aforementioned constituents of the coating formulation, typically used in the production of photoconductive paper.

It is preferred that an amount of tellurium, calculated as Te, of at least 0.01% by weight, based on the weight of the zinc oxide, be mixed with the photoconductive zinc oxide powder for the reason that with an amount of tellurium materially less than 0.01% by weight, or with no tellurium mixed with the zinc oxide, the property of consistently attaining a considerably faster discharge speed is not realized. For optimum results, the amount of tellurium, calculated as Te, mixed or blended with the photoconductive zinc oxide powder should not exceed 0.03% by weight, based on the weight of the zinc oxide. However, amounts of tellurium, calcualted as Te, in excess of 0.03% by weight and as high as 0.05% by weight, based on the weight of the zinc oxide, mixed with the photoconductive zinc oxide powder, give satisfactory results and are utilizable herein although the additional amount of Te above 0.03% provides little, if any, improvement in discharge speed and is costly.

According to the invention, the heat treatment of the zinc oxide-tellurium mixture is carried out at a temperature of 200° C. or higher for a time which is usually in the range of about 5 minutes to about 90 minutes. The temperature and time of the heat treatment of the zinc oxide-tellurium mixture are dependent on each other, and it is critical in the process of this invention that one or both of the heating temperature and heating time be below or less than that heating temperature and heating time at which significant sintering of the thus-treated particulate product occurs. One or both of the heating temperature and heating time must, however, be sufficiently elevated or long in the process herein to result in the photoconductive zinc oxide of improved electrophotographic properties of this invention. Ordinarily, the duration or time of the heat treatment can be less when the temperature of the heat treatment is higher, and the time of the heat treatment can be greater when the heat treatment temperature is lower. As exemplary, the time of heat treatment can be 5 minutes at temperature of the heat treatment of about 450° C. and 90 minutes at temperature of the heat treatment of 200° C. The optimum temperature for the heat treatment, however, depends upon the physical characteristics of the particular zinc oxide being utilized, and the optimum time of the heat treatment is dependent upon the particular temperature selected for the reasons disclosed previously herein regarding the prevention of sintering while still attaining the improved electrophotographic properties.

The tellurium utilizable herein can be supplied in any suitable form or source of the tellurium. Thus the tellurium can be elemental tellurium per se, an oxide of tellurium, an oxygen-and tellurium-containing acid or a salt thereof, e.g. an alkali metal salt thereof, or a compound of tellurium oxidizable or decomposable to an oxidized form of the tellurium under the conditions of the process of the invention. As exemplary, the tellurium utilizable herein can be Te per se, telluric acid, sodium tellurate, tellurium dioxide and zinc telluride.

The free oxygen-containing gas is exemplified by air and oxygen-enriched air.

The mixing of the tellurium with the photoconductive zinc oxide powder followed by heating the mixture in contact with air at the temperature of at least 200° C. and more preferably in the range of 300° C. to 475° C. results in a product having the property of consistently discharging very rapidly. Such considerable improvements in the discharge speed provided by the tellurium was entirely unexpected over the prior art teachings.

The process is carried out with the photoconductive zinc oxide powder-tellurium mixture in a fluidized bed during the contacting of such mixture with the free oxygen-containing gas, such mixture being at the elevated temperature previously disclosed herein during this contacting in the fluidized bed. In this fluidized bed, the zinc oxide-tellurium mixture particles are fluidized, i.e. maintained in constant and random motion with respect to each other, by forced flow of the free oxygen-containing gas stream or streams into contact with the particles at a velocity which is sufficient to fluidize the particles. Ordinarily, only a portion of the particles are fluidized in this invention, although all or substantially all of the particles may be fluidized. The fluidized bed is ordinarily provided herein by flowing the stream of free-oxygen-containing gas upwardly into an enclosed vessel and into contact with the particles therein. Alternatively, the process can also be carried out by blowing a stream of the free oxygen-containing gas through a gas-pervious bed or mass of a mixture of the particulate tellurium and particulate zinc oxide, with the tellurium-zinc oxide mixture heated at the temperature previously disclosed herein. Also, the process can, if desired, be carried out in air or other free-oxygen-containing gas by heating a mixture or blend of the particulate tellurium and photoconductive zinc oxide powder at the temperature previously disclosed herein in a suitable container which is open to the air or other free-oxygen containing gas. This latter static air or other free oxygen-containing gas process of preparation is not preferred due to a thermal gradient occurring in the mass of the tellurium-zinc oxide mixture. The thermal gradient is undesirable as it may cause sintering of the particles of this tellurium-zinc oxide with consequent grittiness of the photoconductive coating on the ultimate photoconductive paper.

The zinc oxide powder-tellurium mixture should not be heated at temperature much above 475° C. for the reason undesirable agglomerating and building up of the mixture particles occurs at temperatures much above 475° C. Temperatures of heating the zinc oxide-tellurium mixture much below 200° C. should be avoided for the reason an excessively prolonged time is required to attain the improved electrophotographic properties at lower temperatures much below 200° C. which is unfeasible, and moreover the improved electrophotographic properties may not be attainable at temperatures much below 200° C.

DESCRIPTION OF THE PREFERRED EMBODIMENTS

The photoconductive zinc oxide powder-tellurium mixture is preferably heated at a temperature of about 300° C. or higher, and more preferably at a temperature in the range of about 300° C. to about 450° C.

Preferably the photoconductive zinc oxide-tellurium mixture is contacted with the free-oxygen-containing gas with at least a portion; more preferably at least a major portion, i.e. more than 50%, substantially all or all; of the zinc oxide-tellurium mixture in a fluidized state during such contacting.

Tests were conducted to compare certain electrophotographic properties of photoconductive zinc oxide having tellurium added thereto and prepared by the process of the present invention with the electrophotographic properties of the same photoconductive zinc oxide not having tellurium added thereto and not treated by the process of the present inventions, and also with such properties of a prior art high speed photoconductive zinc oxide. In carrying out the tests, a plurality of samples of photoconductive zinc oxide powder were blended with finely particulate tellurium in varying amounts and treated by air permeation at a temperature of 350° C. for a certain time in the range of 30 to 90 minutes. The thus-treated samples of zinc oxide powder containing tellurium as additive, of the untreated photoconductive zinc oxide not containing tellurium as additive and of the prior art high speed photoconductive zinc oxide were each combined with the same binder and applied to base paper. The maximum charge acceptance, i.e. MCA, in Table I, and in the other tables of test results hereinafter set forth and the charge-discharge speed, i.e. Disch. Speed, in Table I and also in the other tables herein, were measured by Dyntest 90 equipment. The results are set forth in Table I which follows:

TABLE I

| | | | | | Air Permeation Heat Treating + Blending | | | | | |
|---|---|---|---|---|---|---|---|---|---|---|
| | | | | | Treated Photoconductive Zinc Oxide | | Untreated AZOFAX-22 Photoconductive Zinc Oxide | | Prior Art High Speed Photoconductive Zinc Oxide | |
| Photoconductive Zinc Oxide | Temp. °C. | Time (Minutes) | Amount of Additive % | Additive | (V) MCA | (V/S) Disch. Speed | (V) MCA | (V/S) Disch. Speed | (V) MCA | (V/S) Disch. Speed |
| AZOFAX-22 | 350 | 30 | — | — | 743 | 40 | 693 | 37 | 587 | 87 |
| " | 350 | 60 | — | — | 755 | 47 | 693 | 37 | 587 | 87 |
| " | 350 | 90 | — | — | 758 | 50 | 693 | 37 | 587 | 87 |
| " | 350 | 30 | 0.01 | Te | 783 | 57 | 712 | 36 | 615 | 88 |
| " | 350 | 60 | 0.01 | Te | 810 | 59 | 712 | 36 | 615 | 88 |
| " | 350 | 90 | 0.01 | Te | 768 | 53 | 712 | 36 | 615 | 88 |
| " | 350 | 30 | 0.02 | Te | 805 | 55 | 718 | 35 | 605 | 87 |
| " | 350 | 60 | 0.02 | Te | 830 | 54 | 718 | 35 | 605 | 87 |
| " | 350 | 90 | 0.02 | Te | 788 | 55 | 718 | 35 | 605 | 87 |
| " | 350 | 30 | 0.05 | Te | 727 | 54 | 668 | 37 | 555 | 88 |
| " | 350 | 60 | 0.05 | Te | 768 | 62 | 668 | 37 | 555 | 88 |
| " | 350 | 90 | 0.05 | Te | 760 | 56 | 668 | 37 | 555 | 88 |
| AZOFAX-661 | 350 | 30 | — | — | 600 | 91 | 542 | 73 | 567 | 85 |
| " | 350 | 60 | — | — | 618 | 89 | 542 | 73 | 567 | 85 |
| " | 350 | 90 | — | — | 620 | 93 | 542 | 73 | 567 | 85 |
| " | 350 | 30 | 0.01 | Te | 625 | 83 | 510 | 71 | 582 | 85 |
| " | 350 | 60 | 0.01 | Te | 632 | 83 | 510 | 71 | 582 | 85 |
| " | 350 | 90 | 0.01 | Te | 618 | 92 | 510 | 71 | 582 | 85 |
| " | 350 | 30 | 0.02 | Te | 613 | 83 | 545 | 74 | 587 | 86 |
| " | 350 | 60 | 0.02 | Te | 648 | 87 | 545 | 74 | 587 | 86 |
| " | 350 | 90 | 0.02 | Te | 620 | 86 | 545 | 74 | 587 | 86 |
| " | 350 | 30 | 0.05 | Te | 613 | 80 | 553 | 71 | 615 | 93 |
| " | 350 | 60 | 0.05 | Te | 652 | 85 | 553 | 71 | 615 | 93 |
| " | 350 | 90 | 0.05 | Te | 647 | 76 | 553 | 71 | 615 | 93 |

The considerable improvement in discharge speed in volts per second, (V/S), provided by the addition of the tellurium to the photoconductive zinc oxide and heating in accordance with the present invention over that of the untreated photoconductive AZOFAX-22 or AZOFAX-661 zinc oxide per se, i.e. not containing added tellurium and not treated in accordance with the present invention, is shown by the test results of Table I. In this regard, closer inspection of Table I shows that in all cases the discharge speed is at least 10% higher for the zinc oxide-tellurium mixture treated in accordance with the invention relative to the same grade of zinc oxide in untreated form. In foregoing Table I, the AZOFAX-22 zinc oxide is a photoconductive zinc oxide of average particle size of 0.22 micron and the AZOFAX-661 zinc oxide is a photoconductive zinc oxide of average particle size of about 0.34 micron.

It should also be noted that in all cases the maximum charge acceptance (MCA) of the Te containing and heat treated zinc oxide, is greater than the corresponding unprocessed AZOFAX-22 or AZOFAX-661 photoconductive zinc oxide.

Additional tests were also conducted to compare the electrophotographic properties of photoconductive zinc oxide containing tellurium and heated in accordance with the process of the present invention with those of the same photoconductive zinc oxide not containing tellurium as additive and not heat treated, and with the electrophotographic properties of a prior art high speed photoconductive zinc oxide. In carrying out the tests, a plurality of samples of photoconductive zinc oxide powder were blended with finely particulate tellurium in varying amounts and contacted with air in a fluidized bed and heated in the fluidized bed at temperatures from 200° C. to 450° C. for the desired length of time. The thus-treated samples of zinc oxide powder containing tellurium as additive and of the untreated photoconductive zinc oxide not containing tellurium as additive and not heat treated and of the prior art high speed photoconductive zinc oxide not heat treated were each combined with the same binder and applied to paper. The maximum charge acceptance, i.e. MCA, and the charge discharge speed, i.e. Disch. Speed, were measured by Dyntest 90 equipment. The results are set forth hereafter in Table II:

TABLE II

| | | | | | Treated Photoconductive Zinc Oxide | | Untreated AZOFAX-661 Photoconductive Zinc Oxide | | Priop Art High Speed Photoconductive Zinc Oxide | |
|---|---|---|---|---|---|---|---|---|---|---|
| Photoconductive Zinc Oxide | Temp. °C. | Time (Minutes) | Amount of Additive % | Additive | (V) MCA | (V/S) Disch. Speed | (V) MCA | (V/S) Disch. Speed | (V) MCA | (V/S) Disch. Speed |
| AZOFAX-661 | 200 | 10 | 0.01 | Te | 600 | 63 | 580 | 55 | 582 | 66 |
| " | 300 | 10 | 0.01 | Te | 628 | 70 | 580 | 55 | 582 | 66 |
| " | 300 | 10 | 0.01 | Te | 677 | 64 | 607 | 55 | 628 | 73 |
| " | 350 | 10 | 0.01 | Te | 642 | 67 | 580 | 55 | 582 | 66 |
| " | 350 | 10 | 0.01 | Te | 655 | 64 | 607 | 55 | 628 | 73 |

TABLE II-continued

| Photoconductive Zinc Oxide | Temp. °C. | Time (Minutes) | Amount of Additive % | Additive | Treated Photoconductive Zinc Oxide (V) MCA | Treated Photoconductive Zinc Oxide (V/S) Disch. Speed | Untreated AZOFAX-661 Photoconductive Zinc Oxide (V) MCA | Untreated AZOFAX-661 Photoconductive Zinc Oxide (V/S) Disch. Speed | Priop Art High Speed Photoconductive Zinc Oxide (V) MCA | Priop Art High Speed Photoconductive Zinc Oxide (V/S) Disch. Speed |
|---|---|---|---|---|---|---|---|---|---|---|
| " | 400 | 10 | 0.01 | Te | 638 | 63 | 580 | 55 | 582 | 66 |
| " | 400 | 10 | 0.01 | Te | 648 | 61 | 607 | 55 | 628 | 73 |
| " | 450 | 10 | 0.01 | Te | 647 | 60 | 607 | 55 | 628 | 73 |

The considerably higher maximum charge acceptance, i.e. "MCA" attained by the photoconductive zinc oxide containing tellurium and prepared by the present invention over the maximum charge acceptance attained by this photoconductive zinc oxide not containing tellurium and not prepared by the present invention, and over the maximum charge acceptance attained by the prior art high speed photoconductive zinc oxide, is shown by the test results in Table II. The table II test results also show that in a plurality of the test runs, the photoconductive zinc oxide containing tellurium and prepared by the present invention also attained a discharge speed, i.e. Disch. Speed, approaching an even surpassing the discharge speed of the prior art high speed photoconductive zinc oxide. These highly desirable results were entirely unexpected.

Tests were also carried out to compare the electrophotographic properties of photoconductive zinc oxide having tellurium added thereto and prepared by the process of the present invention with the electrophotographic properties of the same photoconductive zinc oxide not having tellurium added thereto and those of prior art high speed photoconductive zinc oxide. In carrying out the tests, a plurality of samples of photoconductive zinc oxide powder were mixed together with the tellurium for certain of the tests, and the thus-obtained samples were each separately contacted with a stream of air at temperature in the range of 350° C. to 450° C. In all tests, the photoconductive zinc oxide powder-tellurium mixtures were separately charged into the lower portion of an upright column having a layer of heat insulation material surrounding the outer surface of the column. A stream of hot air at a certain temperature in the range of 350° C. to 450° C. was supplied into the bottom of the column at a high velocity which was sufficient to fluidize a significant portion of the finely particulate zinc oxide-tellurium charge in the column. The thus-treated samples of zinc oxide powder separately containing tellurium as additive, of the same photoconductive zinc oxide powder not containing tellurium as additive and of untreated prior art high speed photoconductive zinc oxide were each combined with the same binder and applied to base paper. The maximum charge acceptance, i.e. MCA, and the charge discharge speed, i.e. Disch. Speed, in the test results in the table hereafter set forth, were measured by Dyntest 90 equipment. The results are set forth hereafter in Table III. In certain of the tests the results of which are set forth in Table III, the tellurium additive was tellurium per se, i.e. Te, in other of these tests, the tellurium additive was sodium tellurate, in still other of the tests, the tellurium additive was telluric acid, in other of such tests, the tellurium additive was ZnTe, and in still other of the tests, the tellurium was $TeO_2$.

TABLE III

| Photoconductive Zinc Oxide | Temp. °C. | Time (Minutes) | Amount of Additive % | Additive | Treated Photoconductive Zinc Oxide (V) MCA | Treated Photoconductive Zinc Oxide (V/S) Disch. Speed | Untreated AZOFAX-661 Photoconductive Zinc Oxide (V) MCA | Untreated AZOFAX-661 Photoconductive Zinc Oxide (V/S) Disch. Speed | Prior Art High Speed Photoconductive Zinc Oxide (V) MCA | Prior Art High Speed Photoconductive Zinc Oxide (V/S) Disch. Speed |
|---|---|---|---|---|---|---|---|---|---|---|
| AZOFAX-661 | 450 | 10 | 0.003 | Te | 712 | 61 | 632 | 58 | 650 | 70 |
| " | 450 | 10 | 0.005 | Te | 703 | 64 | | | | |
| " | 450 | 10 | 0.008 | Te | 708 | 67 | | | | |
| " | 450 | 10 | 0.01 | Te | 680 | 74 | 618 | 62 | 600 | 70 |
| " | 450 | 10 | 0.03 | Te | 667 | 66 | | | | |
| " | 450 | 10 | 0.04 | Te | 675 | 65 | | | | |
| " | 450 | 10 | 0.022 | $Na_2H_4TeO_6$ (Sodium Tellurate) | 675 | 75 | 602 | 61 | 600 | 70 |
| " | 400 | 10 | 0.022 | $Na_2H_4TeO_6$ (Sodium Tellurate) | 666 | 71 | | | | |
| " | 350 | 10 | 0.022 | $Na_2H_4TeO_6$ (Sodium Tellurate) | 630 | 69 | | | | |
| " | 450 | 10 | 0.024 | Telluric Acid | 675 | 84 | 605 | 73 | 593 | 79 |
| " | 400 | 10 | 0.024 | " | 622 | 73 | | | | |
| " | 350 | 10 | 0.024 | " | 635 | 67 | 605 | 73 | 597 | 79 |
| " | 450 | 10 | 0.015 | Zn Te | 607 | 77 | 595 | 66 | 537 | 72 |
| " | 400 | 10 | 0.015 | Zn Te | 618 | 76 | | | | |
| " | 350 | 10 | 0.015 | Zn Te | 617 | 69 | | | | |
| " | 350 | 30 | 0.02 | Te | 613 | 83 | 545 | 74 | 517 | 86 |
| " | 350 | 60 | 0.02 | Te | 648 | 87 | | | | |
| " | 350 | 90 | 0.02 | Te | 620 | 86 | | | | |
| " | 350 | 30 | 0.05 | Te | 613 | 80 | 553 | 71 | 615 | 93 |
| " | 350 | 60 | 0.05 | Te | 652 | 85 | | | | |

TABLE III-continued

| Photoconductive Zinc Oxide | Temp. °C. | Time (Minutes) | Amount of Additive % | Additive | Treated Photoconductive Zinc Oxide (V) MCA | Treated Photoconductive Zinc Oxide (V/S) Disch. Speed | Untreated AZOFAX-661 Photoconductive Zinc Oxide (V) MCA | Untreated AZOFAX-661 Photoconductive Zinc Oxide (V/S) Disch. Speed | Prior Art High Speed Photoconductive Zinc Oxide (V) MCA | Prior Art High Speed Photoconductive Zinc Oxide (V/S) Disch. Speed |
|---|---|---|---|---|---|---|---|---|---|---|
| " | 350 | 90 | 0.05 | Te | 647 | 76 | | | | |
| " | 450 | 30 | 0.01 | $TeO_2$ | 617 | 68 | 637 | 51 | 608 | 55 |
| " | 450 | 60 | 0.01 | $TeO_2$ | 620 | 56 | 637 | 51 | 608 | 55 |
| " | 450 | 90 | 0.01 | $TeO_2$ | 625 | 61 | | | | |
| " | 350 | 30 | 0.02 | $TeO_2$ | 592 | 65 | 542 | 58 | 573 | 61 |
| " | 350 | 60 | 0.02 | $TeO_2$ | 605 | 64 | | | | |
| " | 350 | 90 | 0.02 | $TeO_2$ | 550 | 64 | | | | |

The test results set forth in Table III shows the considerable improvement in maximum charge acceptance (MCA) and in discharge speed attained by the addition of the tellurium to the AZOFAX-661 photoconductive zinc oxide and heating over that of the photoconductive AZOFAX-661 zinc oxide per se, i.e. not containing tellurium as additive.

The test results of Table III also show that in a plurality of the test runs, the photoconductive zinc oxide containing tellurium and prepared by the process of the present invention also attained a discharge speed, i.e. Disch. Speed, approaching and even surpassing the discharge speed of the prior art high speed photoconductive zinc oxide. Such very desirable results were also entirely unexpected results and were not predictable in view of the prior art.

The foregoing test data clearly indicates that the new process of the invention results in at least a 10% increase in the discharge speed of the photoconductive zinc oxide. This surprising result is obtained without adversely affecting other electrophotographic properties of the photoconductive zinc oxide or its compatability with other ingredients of the coating composition. In fact, the maximum charge acceptance (MCA) of the treated zinc oxide is typically higher than that of the corresponding untreated zinc oxide.

Although the invention has been described in terms of specific preferred embodiments, it should be apparent that various modifications may be made without departing from the spirit of the invention. Accordingly, reference should be made to the following claims to determine the scope of the invention.

We claim:

1. A method for increasing the discharge speed of photoconductive zinc oxide particles by at least 10% relative to the discharge speed of the corresponding untreated zinc oxide particles comprising (a) mixing said zinc oxide particles with from about 0.01% to 0.03% tellurium calculated as Te and based on the weight of zinc oxide; and (b) contacting the resulting mixture with a free-oxygen-containing gas while heating the mixture at a temperature from about 300° C. to about 450° C. for a time sufficient to result in said at least 10% increase in said discharge speed and less than the time resulting in sintering of said mixture, said time being at least about 10 minutes and less than about 90 minutes.

2. The process of claim 1 wherein the free oxygen-containing gas is air.

3. The process of claim 2 wherein the free oxygen-containing gas is oxygen-enriched air.

4. The process of claim 1 wherein at least a portion of the mixture is in a fluidized bed during the contacting of the mixture with the free oxygen-containing gas.

5. The process of claim 4 wherein the mixture is in a fluidized bed during the contacting of the mixture with the free oxygen-containing gas.

6. The process of claim 1 wherein the mixture is heated in the presence of static air.

7. The process of claim 1 wherein the alkali metal tellurate is sodium tellurate.

8. The process of claim 1 wherein the tellurium is of particle size of −100 mesh.

9. The method of claim 1 wherein said tellurium of the mixture at the outset of said contacting step is chosen from the group consisting of Te, $TeO_2$, telluric acid and alkali metal tellurate.

10. A photoconductive zinc oxide characterized by having a discharge speed at least 10% greater than the discharge speed of the corresponding untreated zinc oxide particles and produced by a process comprising mixing photoconductive zinc oxide powder with from 0.01% to 0.03% by weight of tellurium, calculated as Te, and contacting the thus-obtained mixture with a free oxygen-containing gas while heating the mixture at a temperature in the range of about 300° C. to about 450° C. for a time of at least about 10 minutes and sufficient to result in the zinc oxide having the improved electrophotographic properties, at least one of the heating temperature and time being below that temperature or time at which significant sintering of the zinc oxide powder occurs.

* * * * *